US009132658B2

(12) United States Patent
Toya

(10) Patent No.: US 9,132,658 B2
(45) Date of Patent: Sep. 15, 2015

(54) PRINTING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 14/218,442

(22) Filed: Mar. 18, 2014

(65) Prior Publication Data

US 2014/0292851 A1 Oct. 2, 2014

(30) Foreign Application Priority Data

Mar. 27, 2013 (JP) ..... 2013-065798

(51) Int. Cl.

| | |
|---|---|
| ***B41J 2/15*** | (2006.01) |
| ***B41J 2/21*** | (2006.01) |
| ***B41J 3/407*** | (2006.01) |
| ***B41J 15/04*** | (2006.01) |

(52) U.S. Cl.

CPC ..... *B41J 2/2114* (2013.01); *B41J 2/2128* (2013.01); *B41J 3/407* (2013.01); *B41J 15/04* (2013.01)

(58) Field of Classification Search

CPC ..... B41J 11/002; B41J 29/38; B41J 11/0085; B41J 3/60; B41J 11/0095

See application file for complete search history.

(56) References Cited

U.S. PATENT DOCUMENTS 6,474,778 B1 * 11/2002 Koitabashi et al. ..... 347/43
6,517,191 B1 * 2/2003 Koitabashi ..... 347/43

FOREIGN PATENT DOCUMENTS

JP 2002-307755 10/2002

* cited by examiner

*Primary Examiner* — Lamson Nguyen
(74) *Attorney, Agent, or Firm* — Workman Nydegger

(57) ABSTRACT

A printing apparatus includes a head and a control unit. The head discharges an imaging liquid for forming an image, and a supplementary liquid for supplementing formation of the image onto a printing medium. The control unit controls the head to execute a first operation, in which the imaging liquid is discharged onto a first region and a second operation, in which the supplementary liquid is discharged onto a region of the printing medium onto which the imaging liquid is not discharged. The control unit controls the head such that the discharge amount of the supplementary liquid on a second region, which is adjacent to the first region, is less than the discharge amount of the supplementary liquid on a third region, which is a region onto which the imaging liquid is not discharged and is not adjacent to the first region.

8 Claims, 11 Drawing Sheets

PRINTING APPARATUS

BACKGROUND

1. Technical Field

The present invention relates to a printing apparatus.

2. Related Art

As the printing apparatus, an ink jet printer is known, which forms an image on a printing medium by discharging an ink from a head.

As an example of such an ink jet printer, there is a printer that performs printing using colored inks such as CMY and a non-colored transparent ink (clear ink).

JP-A-2002-307755 is an example of the related art.

Here, there is a case in which a film-based medium that is configured from polystyrene, polypropylene or the like is used as the printing medium. In regard to the film-based medium, there is a case in which a charge is generated on the medium surface due to friction and the like between the film-based medium and a paper feed roller, which is formed from a metal (aluminum, steel or the like), within the printer. The amount of charge is influenced by the state of the friction; therefore, there is variation on the medium surface.

When the ink is discharged onto the printing medium in which there is variation in the amount of charge, an ink mist (so-called satellites) which is generated together with the discharging accumulates in a region at which the amount of charge is great. As a result, there is a case in which hazy image degradation occurs in the printed object.

On the other hand, it is possible to reduce the amount of charge to be substantially uniform by applying a supplementary ink such as a clear ink to the entire printing medium in advance.

However, when the clear ink is applied to the printing medium, there is a problem in that the imaging ink (colored ink) and the clear ink mix together, causing bleeding to occur in the image.

SUMMARY

An advantage of some aspects of the invention is to provide a printing apparatus that is capable of reducing bleeding of the image, even when the supplementary ink (clear ink or the like) is used.

The main invention is a printing apparatus that includes a head and a control unit. The head discharges an imaging liquid for forming an image, and a supplementary liquid for supplementing formation of the image with the imaging liquid onto a printing medium. The control unit controls the head to execute a first operation, in which the imaging liquid is discharged onto a first region of the printing medium, and a second operation, in which the supplementary liquid is discharged onto a region of the printing medium onto which the imaging liquid is not discharged. The control unit controls the head such that the discharge amount of the supplementary liquid on a second region, which is a region onto which the imaging liquid is not discharged and is adjacent to the first region, is less than the discharge amount of the supplementary liquid on a third region, which is a region onto which the imaging liquid is not discharged and is not adjacent to the first region.

Other features of the invention will be made clear by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

Figure 1:
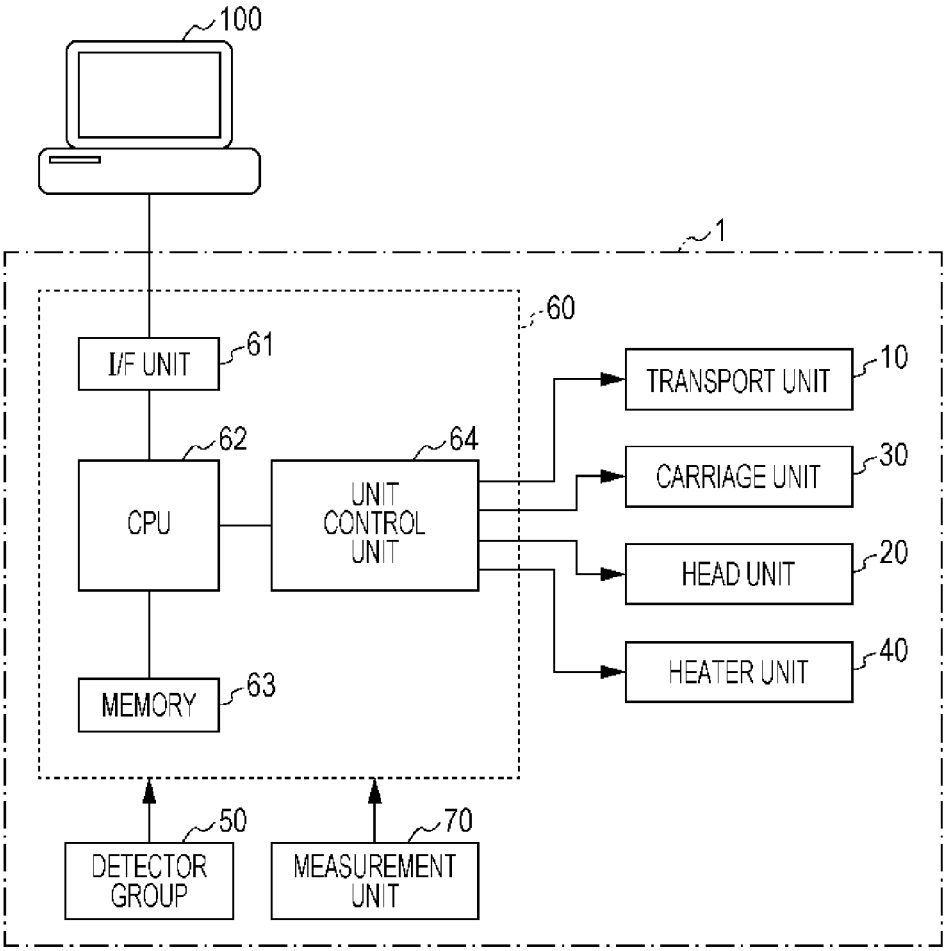
FIG. 1 is a diagram showing the configuration of a printing apparatus according to an embodiment.

At least the following will be made clear by the description of the specification and the accompanying drawings.

According to an aspect of the invention, there is provided a printing apparatus, including a head which discharges an imaging liquid for forming an image, and a supplementary liquid for supplementing formation of the image with the imaging liquid onto a printing medium; and a control unit which controls the head to execute a first operation, in which the imaging liquid is discharged onto a first region of the printing medium, and a second operation, in which the supplementary liquid is discharged onto a region of the printing medium onto which the imaging liquid is not discharged, in which the control unit controls the head such that a discharge amount of the supplementary liquid on a second region, which is a region onto which the imaging liquid is not discharged and is adjacent to the first region, is less than the discharge amount of the supplementary liquid on a third region, which is a region onto which the imaging liquid is not discharged and is not adjacent to the first region.

The printing apparatus is capable of reducing the bleeding of the image, even when the supplementary liquid is used.

The control unit may control the head such that a dot size of the supplementary liquid that is discharged onto the second region is smaller than the dot size of the supplementary liquid that is discharged onto the third region.

The printing apparatus is capable of reducing the bleeding of the image, even when the supplementary liquid is used.

The control unit may control the head such that an interval of dots of the supplementary liquid that is discharged onto the second region, is wider than the interval of the dots of the supplementary liquid that is discharged onto the third region.

When the supplementary liquid is used, the printing apparatus is capable of saving the amount of the supplementary liquid used, while reducing the bleeding of the image.

The control unit may control the head to not discharge the supplementary liquid onto the second region.

When the supplementary liquid is used, the printing apparatus is capable of saving the amount of the supplementary liquid used, while reducing the bleeding of the image.

The control unit may be capable of selectively executing a plurality of modes in which the discharge amount of the supplementary liquid in the second operation differs.

The printing apparatus is capable of selecting the discharge amount of the supplementary liquid.

The printing apparatus may also include a measurement unit which measures a moisture of the printing medium, and when a measurement result obtained by the measurement unit is a predetermined threshold value or less, the control unit may control the head to increase the discharge amount of the supplementary liquid.

The printing apparatus is capable of increasing the discharge amount of the supplementary liquid when the moisture is low.

The control unit may control the head to execute the first operation and the second operation in a same pass.

According to the printing apparatus, it is possible to efficiently create a printed object.

When a region, which is peeled off after the image is printed, is present in a region onto which the imaging liquid is not discharged, the control unit may control the head to not execute the second operation in relation to the peel-off region.

The printing apparatus is capable of selectively causing the satellites to accumulate on the peel-off region.

Configuration of Printing Apparatus

Figure 2:
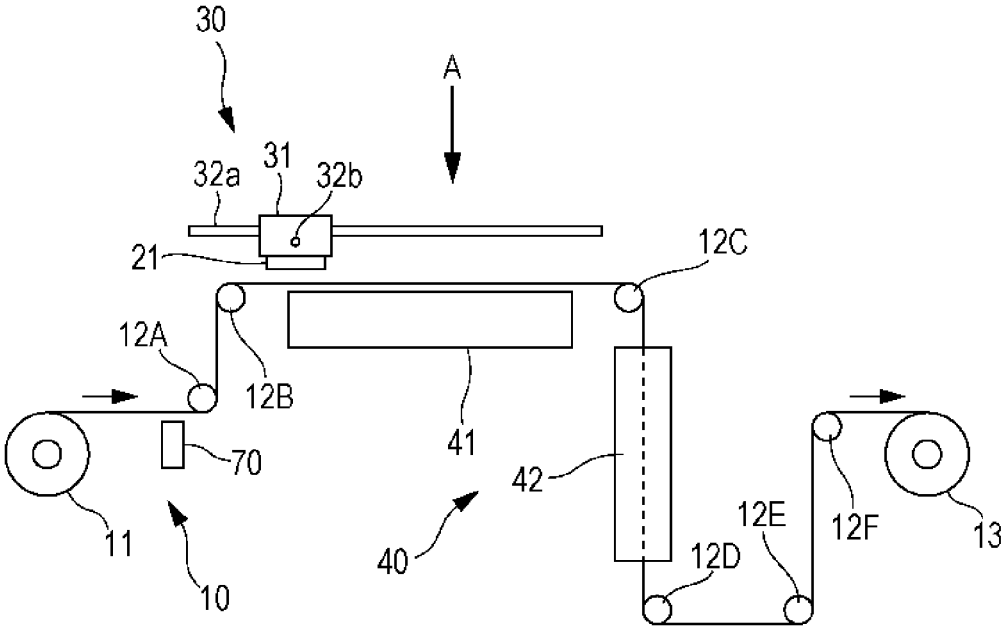
FIG. 2 is a diagram showing the configuration of the printing apparatus according to the embodiment.
Figure 3:
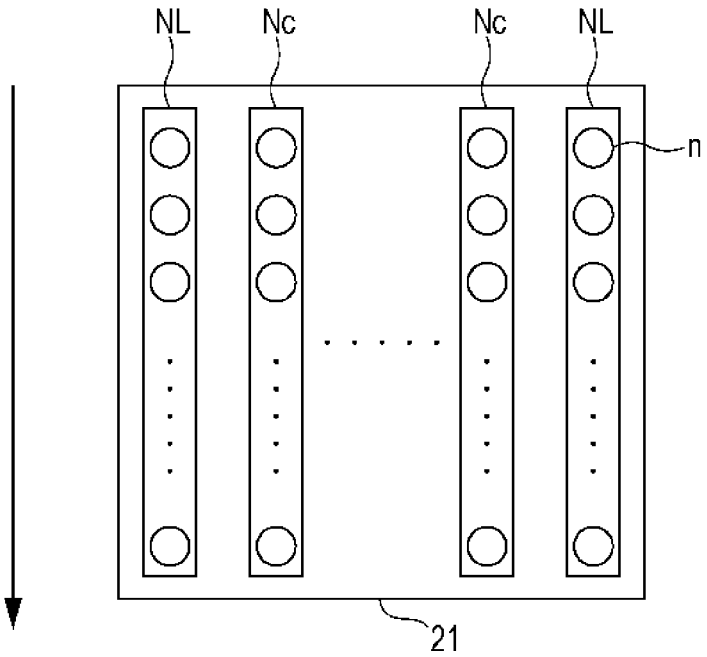
FIG. 3 is a diagram showing the configuration of the printing apparatus according to the embodiment.
Figure 4:
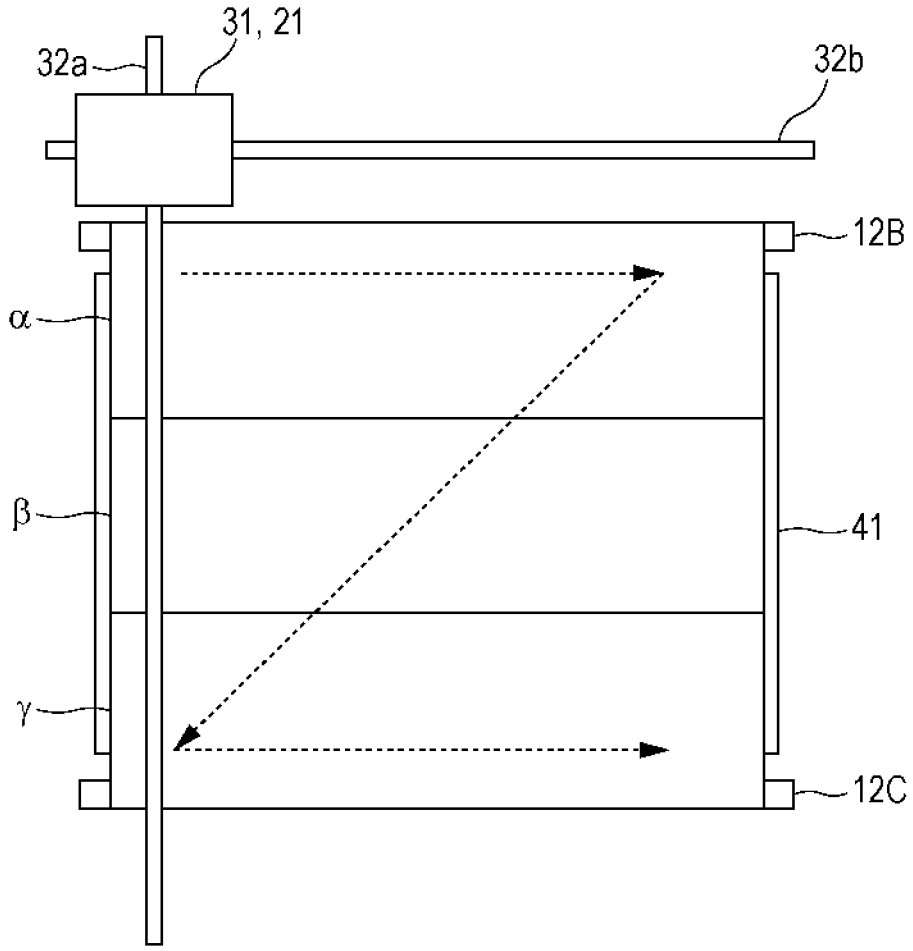
FIG. 4 is a diagram showing the configuration of the printing apparatus according to the embodiment.

Description will be given of a configuration of the printing apparatus according to this embodiment with reference to FIGS. 1 to 4. In this embodiment, a lateral system (described hereinafter) ink jet printer 1 is exemplified as the printing apparatus. FIG. 1 is a block diagram showing the overall configuration of an ink jet printer 1. FIG. 2 is a schematic diagram showing the configuration of a portion of the ink jet printer 1. FIG. 3 is a diagram showing an example of a head 21 (described hereinafter). FIG. 4 is a diagram showing the printing medium when viewed from the A direction in FIG. 2. In FIG. 4, a portion of the configuration shown in FIG. 2 is omitted.

The ink jet printer 1 includes a transport unit 10, a head unit 20, a carriage unit 30, a heater unit 40, a detector group 50, a controller 60, and a measurement unit 70. The ink jet printer 1 that receives the image data for printing from a computer 100, which is an external apparatus, controls each unit (the transport unit 10, the head unit 20, the carriage unit 30, and the heater unit 40) using the controller 60. The controller 60 controls each unit on the basis of the image data received from the computer 100 to form (print) an image on the printing medium. The situation within the ink jet printer 1 is monitored by the detector group 50. The detector group 50 outputs the detection results to the controller 60. The controller 60 controls each unit on the basis of the detection results that are output from the detector group 50.

The transport unit 10 transports a roll-shaped printing medium in a predetermined direction (hereinafter, the direction in which the printing medium is transported is sometimes referred to as the "transport direction"). In this embodiment, description will be given using a film-based medium as an example of the printing medium.

As shown in FIG. 2, the transport unit 10 includes a supply mechanism 11, transport rollers 12A to 12F, and a winding mechanism 13. The supply mechanism 11 feeds the printing medium to the carriage unit 30 (the head unit 20) side. The transport rollers 12A to 12F transport the printing medium, which is fed from the supply mechanism 11, to a position (hereinafter sometimes referred to as the "printing position") at which an image is formed (printed). The transport rollers 12A to 12F transport the printing medium, which has an image formed thereon at the printing position, to the winding mechanism 13. The winding mechanism 13 winds the printing medium on which an image is formed. Note that, in the ink jet printer 1, there is a case in which the supply mechanism 11 side is referred to as the "upstream side", and the winding mechanism 13 side is referred to as the "downstream side".

The head unit 20 includes a head 21. The head 21 in this embodiment discharges the imaging liquid and the supplementary liquid onto the printing medium.

The imaging liquid is a liquid (for example, a colored ink such as cyan, magenta and yellow) for forming an image on the printing medium. The supplementary liquid is a liquid (for example, a clear ink, or a white ink) for supplementing the formation of the image with the imaging liquid.

The image is formed on the printing medium by discharging the imaging liquid from nozzles n (described hereinafter) of the head 21. A layer of the supplementary liquid is formed on the printing medium by discharging the supplementary liquid from the nozzles n (described hereinafter) of the head 21.

FIG. 3 is a schematic diagram showing a surface of the head 21 that opposes the printing medium. The arrow in FIG. 3 shows the transport direction. As shown in FIG. 3, a plurality of nozzle rows are formed such that the nozzles thereof line up in the transport direction on the head 21 in this embodiment. Specifically, a plurality of nozzle rows Nc that discharge a colored ink, which is the imaging liquid, are provided in a direction perpendicular to the transport direction. One nozzle row discharges the same color of colored ink. One row of nozzle rows NL that discharge a clear ink, which is the supplementary liquid, is provided for each of the nozzle rows Nc so as to interpose the nozzle rows Nc. Each nozzle row is configured by a plurality of the nozzles n. One of the nozzles n discharges the liquid that corresponds to one dot.

The carriage unit 30 causes the head unit 20 (the head 21) to move in a predetermined direction. As shown in FIGS. 2 and 4, the carriage unit 30 in this embodiment includes a carriage 31, a guide 32*a*, and a guide 32*b*. The head unit 20 is mounted on the carriage 31. The guide 32*a* is a member for guiding the movement of the carriage 31 in the transport direction. The guide 32*b* is a member for guiding the movement of the carriage 31 in a direction that is perpendicular to the transport direction. Using the guide 32*a* and the guide 32*b*, it is possible to move the carriage 31, on which the head unit 20 is mounted, two dimensionally in respect to the printing medium that is in a printing position. Hereinafter, the direction in which the carriage unit 30 (the head unit 20) moves is sometimes referred to as the "movement direction". The broken line arrows shown in FIG. 4 are an example showing the movement of the carriage unit 30 (the head unit 20).

In this manner, a system in which, by moving the head unit 20 two dimensionally (or, alternatively, one dimensionally) in relation to the printing medium and discharging a liquid, formation of the image is performed without transporting the printing medium is referred to as a "lateral system". When performing formation of the image using the lateral system, at the point in time at which the printing medium is transported, an image that is based on the image data is completed on the printing medium at the printing position.

The heater unit 40 includes a hot platen 41 and a drying mechanism 42. The hot platen 41 is a member that supports the printing medium in the printing position. A heater is built into the hot platen 41, and drying of the liquid (the ink), which forms an image or a layer of a supplementary liquid formed on the printing medium, is carried out by heating the printing medium in the printing position. The drying mechanism 42 is provided closer to the downstream side than the printing position, and the drying of the liquid (the ink) that forms the image or the layer of the supplementary liquid outside of the printing position is promoted by heating the printing medium, on which the image is formed.

The detector group 50 is configured to contain a sensor (not shown) that detects the transportation amount of the printing medium performed by the transport unit 10, an encoder for detecting the rotation amount of a transport roller (not shown) that transports the printing medium, and a linear encoder for detecting the position of the carriage 31 in the movement direction.

The controller 60 is a control unit for performing control of the ink jet printer 1. The controller 60 includes an interface (I/F) unit 61, a CPU 62, memory 63 and a unit control circuit 64.

The interface unit 61 performs transmission and receiving of data between the computer 100 and the ink jet printer 1. The CPU 62 is a computational processing apparatus for performing control of the entire ink jet printer 1. The memory 63 is for securing a region that stores programs, or an operation region of the CPU 62. The memory 63 stores the image data and the like, which is the printing target. The CPU 62 controls each unit via the unit control circuit 64 in accordance with the programs stored in the memory 63, and causes the units to execute various processes.

For example, as shown in FIG. 4, the CPU 62 causes the head unit 21 to move (refer to the broken line arrows of FIG. 4) two dimensionally in accordance with the image data stored in the memory 63 via the unit control circuit 64. In this manner, the ink jet printer 1 forms the image and the layer of the supplementary liquid on each of the printing regions (a print region α to a print region γ) of the printing medium in the printing position. The term "printing regions" refers to regions onto which the imaging liquid and the supplementary liquid are discharged (the regions onto which the image and the layer of the supplementary liquid are formed). In this embodiment, the printing regions correspond to the entire printing medium in the printing position.

In this embodiment, the printing regions are divided into a first region E1, a second region E2, and a third region E3 (refer to FIG. 5, described hereinafter). The first region E1 is a region onto which the imaging liquid is discharged. The second region E2 is a region adjacent to the first region E1, of the regions onto which the imaging liquid is not discharged. The third region E3 is a region that is not adjacent to the first region E1, of the regions onto which the imaging liquid is not discharged. The first region E1, the second region E2, and the third region E3 are configured from a plurality of pixel regions. The term "pixel region" refers to a region on the printing medium that corresponds to the pixels on the image data (the pixels and the pixel regions correspond to one another one-for-one). For example, when the resolution of the image data is 360×360 dpi, the "pixel region" is a square-shaped region with 1/360 inch sides.

The controller 60 controls the head 21 to execute an operation (a first operation) in which the imaging liquid is discharged onto the first region E1 on the printing medium. The controller 60 controls the head 21 to execute an operation (a second operation) in which the supplementary liquid is discharged onto the regions (the second region E2 and the third region E3) onto which the imaging liquid is not discharged on the printing medium.

The measurement unit 70 measures the moisture of the printing medium. The measurement unit 70 is provided within the ink jet printer 1, for example, in the proximity of the printing medium (refer to FIG. 2). The measurement unit 70 in this embodiment is an example of the "measurement unit".

The phrase "measure the moisture of the printing medium" includes both directly measuring the moisture of the printing medium itself, and estimating the moisture of the printing medium by measuring the moisture of the atmosphere of the periphery of the printing medium or the like. Therefore, the measurement unit 70 may be a means of directly measuring the moisture of the printing medium itself, and may also be a means of estimating the moisture of the printing medium by measuring the moisture of the atmosphere of the periphery of the printing medium.

In the later case, the means (the measurement unit 70) of estimating the moisture of the printing medium may also be a means of estimating the moisture of the printing medium itself on the basis of a moisture data table (stored in the memory 63 or the like) that shows the correlation between the actually measured moisture of the atmosphere of the periphery of the printing medium, the pre-measured moisture of the atmosphere of the periphery of the printing medium, and the moisture of the printing medium itself. Furthermore, the measurement unit 70 may also be configured to estimate, of the atmosphere of the periphery of the printing medium, the atmosphere of the upstream side of the printing position onto which the imaging liquid is discharged in the transport path of the printing medium, in particular.

Control of Discharge Operation

Next, description will be given of the control of the discharge operation of the liquid in the ink jet printer 1 according to this embodiment with reference to FIG. 5. FIG. 5 is an enlarged diagram of a portion of the printing medium onto which an imaging liquid C and a supplementary liquid L are discharged. In FIG. 5, the discharged liquid (the dots) are represented by circles. In FIG. 5, each of the square-shaped regions, on which a dot is disposed, represents one pixel region.

For example, when transporting the film-based medium using the transport unit 10, friction is generated between the transport rollers 12A and 12B, the hot platen 41, and the film-based medium. As a result, when the film-based medium reaches the printing position, a charge is generated on the medium surface. Since the amount of charge of the medium surface changes according to the state of the friction, in general, fluctuation occurs in the amount of charge of the medium surface.

Accordingly, in order to equalize the amount of charge across the medium surface, it is desirable that the supplementary liquid be applied thereto.

On the other hand, when the supplementary liquid is applied to the printing medium, there is a likelihood that the imaging liquid and the supplementary liquid will mix together, causing bleeding to occur in the image.

Therefore, the controller 60 (the control unit) controls the head 21 such that the discharge amount of the supplementary liquid on the second region E2, which is a region onto which the imaging liquid is not discharged and is adjacent to the first region E1, is less than the discharge amount of the supplementary liquid on the third region E3, which is a region onto which the imaging liquid is not discharged and is not adjacent to the first region E1.

In this case, first, the controller 60 ascertains the first region E1 to the third region E3on the basis of the image data.

For example, the controller 60 analyses the image data, and ascertains the pixels that form the image, and the pixels that do not form the image. The controller 60 determines a plurality of pixel regions that correspond to the pixels that form the image to be the first region E1. The controller 60 determines whether or not each of the pixels that do not form the image are adjacent to a pixel that forms the image. The controller 60 determines a plurality of pixel regions that correspond to the pixels that are adjacent to the pixels that form the image to be the second region E2. The controller 60 determines a plurality of pixel regions that correspond to the pixels that are not adjacent to the pixels that form the image to be the third region E3.

Next, the controller 60 controls the head 21 to perform discharging of liquid onto the determined first region E1 to the third region E3. Note that, in the following description, one dot of the liquid is discharged in relation to one pixel region.

For example, the controller 60 controls the head 21 to cause the head 21 to discharge the imaging liquid C onto the first region E1.

On the other hand, the controller 60 controls the head 21 such that the discharge amount of the supplementary liquid L that is discharged onto the second region E2, is less than the discharge amount of the supplementary liquid L that is discharged onto the third region E3.

Figure 5:
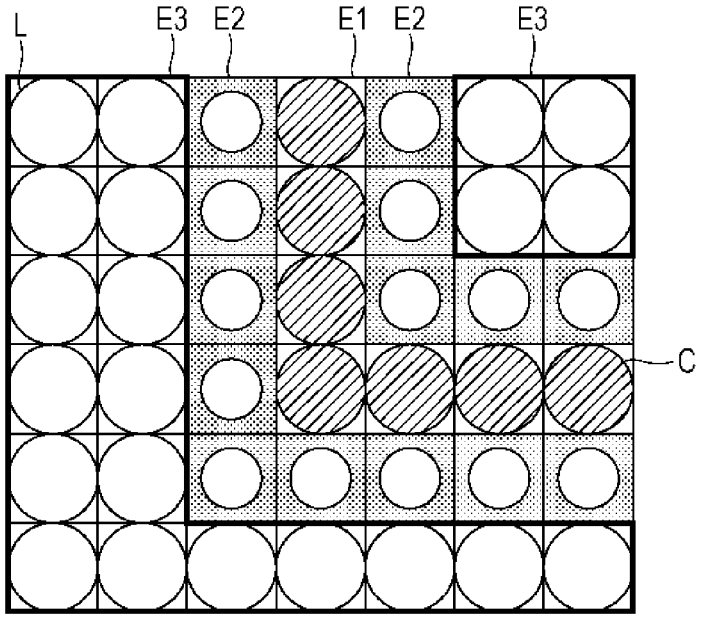
FIG. 5 is a diagram that supplements the description of the control of a discharge operation according to the embodiment.

As a result, as shown in FIG. 5, the dot size of the supplementary liquid L that is discharged onto the second region E2 is smaller than the dot size of the supplementary liquid L that is discharged onto the third region E3.

In other words, since the dots of the supplementary liquid L in the second region E2 are small, the likelihood of making contact with the dots of the imaging liquid C in the first region E1 is low. Therefore, since it is possible to suppress the mixing together of the imaging liquid C and the supplementary liquid L, bleeding of the image does not occur easily. Since a layer of the supplementary liquid L is formed on the portion onto which the imaging liquid C is not discharged, it is possible to equalize the distribution of the amount of charge and to reduce the influence of satellites.

Discharge Operation of Liquid

Next, description will be given of the discharge operation of the liquid in the ink jet printer 1 according to this embodiment with reference to FIGS. 6A to 8D. FIGS. 6A to 8D are diagrams that schematically show the printing medium in the printing position. The image on the printing medium (the layer of the supplementary liquid L) is configured by a plurality of raster lines. A raster line is a row of dots lined up in a direction that is perpendicular to the transport direction of the printing medium. In this embodiment, the "nth raster line" refers to the raster line in the nth position. The term "pass" refers to the operation of forming dots by discharging a liquid from the moving head 21 (the nozzle n).

In this embodiment, there are two patterns of the discharge operation of the imaging liquid C and the supplementary liquid L. For example, one pattern may be set in advance for each of the ink jet printers 1. Alternatively, a plurality of patterns may be stored in the memory 63 or the like, and the operator may set an arbitrary pattern each time printing is performed.

First Pattern

In the first pattern, the controller 60 controls the head 21 to execute the discharging of the imaging liquid C and the discharging of the supplementary liquid L in the same pass, and to execute the discharging of the supplementary liquid L onto the regions (the second region E2 and the third region E3) onto which the imaging liquid C is not discharged.

According to this method, of the printing region of the printing medium at the printing position, a layer of the supplementary liquid L is formed only on the regions onto which the imaging liquid C is not discharged (the regions on which the image is not formed).

First, the head 21 discharges the supplementary liquid L onto the regions (the second region E2 and the third region E3), which are a region that corresponds to the first raster line in the first pass, onto which the imaging liquid C is not discharged. At this time, the head 21 reduces the discharge amount of the supplementary liquid L on the second region E2 to less than the discharge amount of the supplementary liquid L on the third region E3 (refer to FIG. 6A).

Figure 6A:
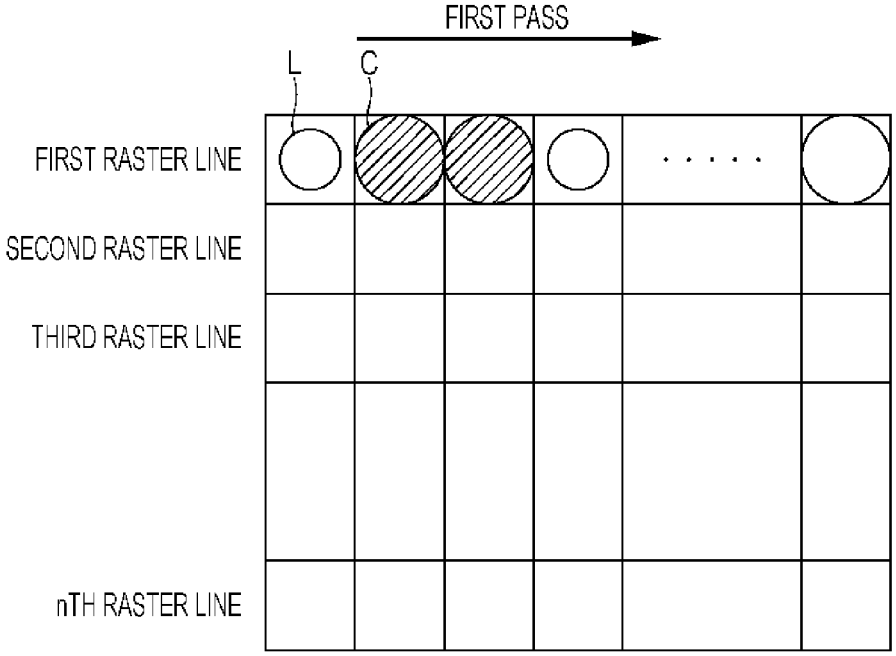
FIG. 6A is a diagram showing a first pattern of the discharge operations of a supplementary liquid and an imaging liquid according to the embodiment.

Furthermore, the head 21 discharges the imaging liquid C onto a region that corresponds to the first raster line and is a region on which the image is formed (the first region E1), in the same pass (the first pass, refer to FIG. 6A). In other words, at the point in time at which the first pass is complete, the imaging liquid C and the supplementary liquid L are discharged onto the first raster line.

Next, the head 21 discharges the supplementary liquid L onto the regions (the second region E2 and the third region E3), which are a region that corresponds to the second raster line in the second pass, onto which the imaging liquid C is not discharged. At this time, the head 21 reduces the discharge amount of the supplementary liquid L on the second region E2 to less than the discharge amount of the supplementary liquid L on the third region E3 (refer to FIG. 6B).

Figure 6B:
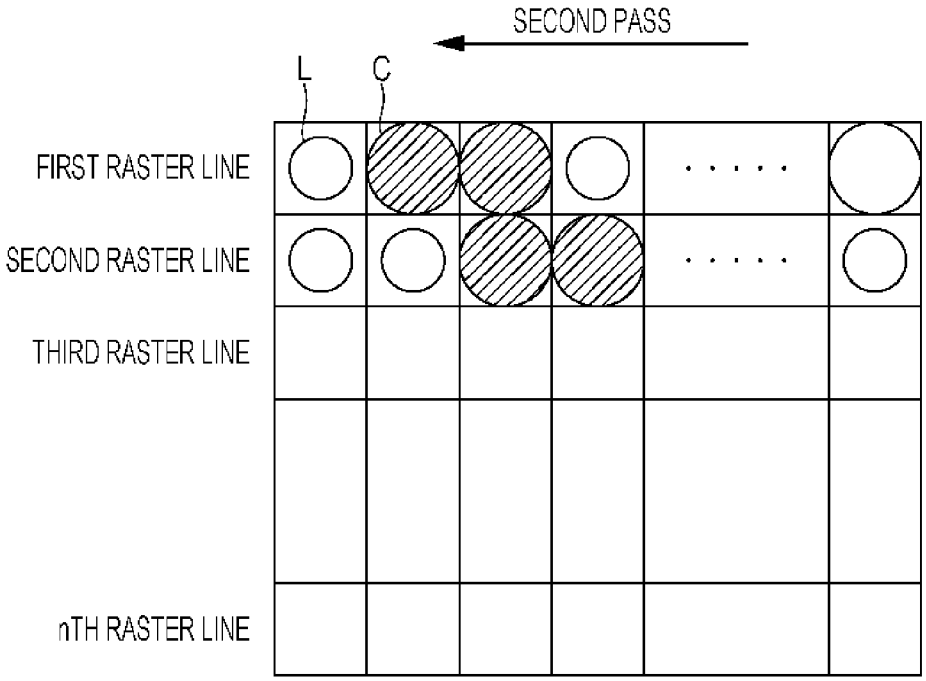
FIG. 6B is a diagram showing the first pattern of the discharge operations of the supplementary liquid and the imaging liquid according to the embodiment.

Furthermore, the head 21 discharges the imaging liquid C onto a region that corresponds to the second raster line and is a region on which the image is formed (the first region E1), in the same pass (the second pass, refer to FIG. 6B). In other words, at the point in time at which the second pass is complete, the imaging liquid C and the supplementary liquid L are discharged onto the second raster line.

In the same manner, the head 21 discharges the supplementary liquid L onto the regions (the second region E2 and the third region E3), which are a region that corresponds to the nth raster line in the nth pass, onto which the imaging liquid C is not discharged. At this time, the head 21 reduces the discharge amount of the supplementary liquid L on the second region E2 to less than the discharge amount of the supplementary liquid L on the third region E3 (refer to FIG. 6C).

Figure 6C:
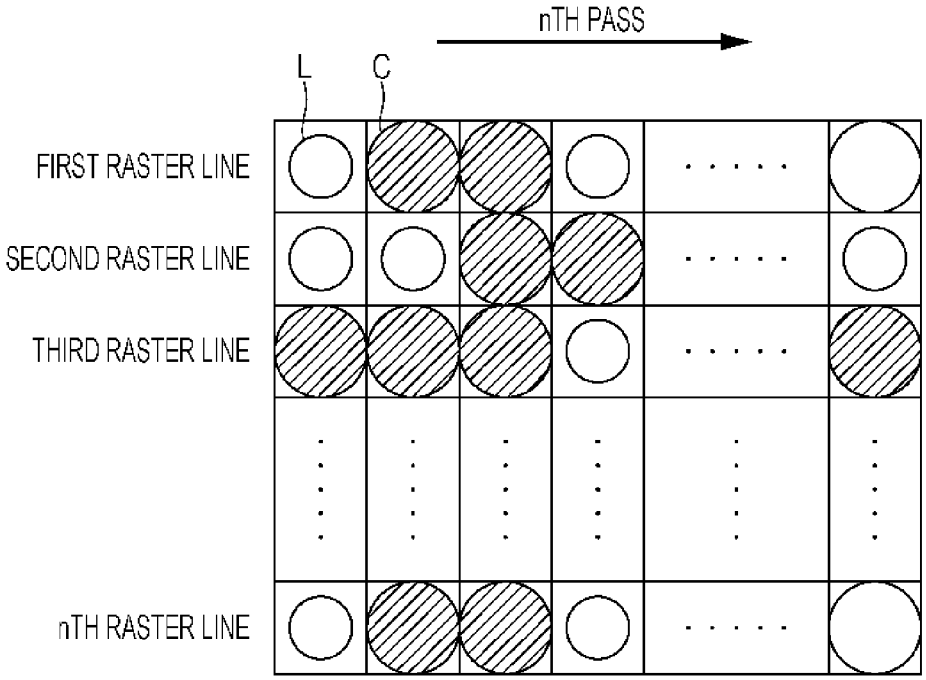
FIG. 6C is a diagram showing the first pattern of the discharge operations of the supplementary liquid and the imaging liquid according to the embodiment.
Figure 7A:
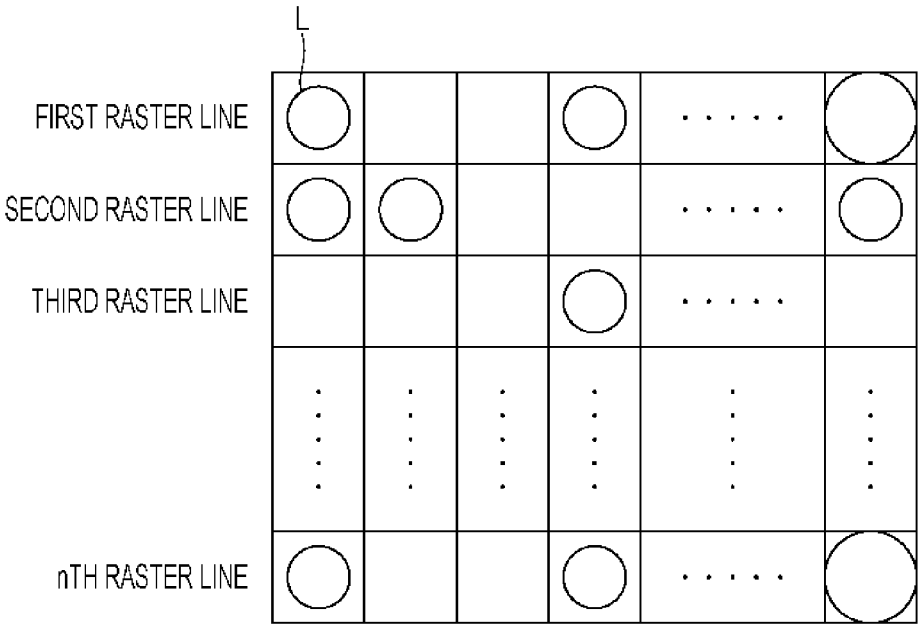
FIG. 7A is a diagram showing a second pattern of the discharge operations of the supplementary liquid and the imaging liquid according to the embodiment.
Figure 7B:
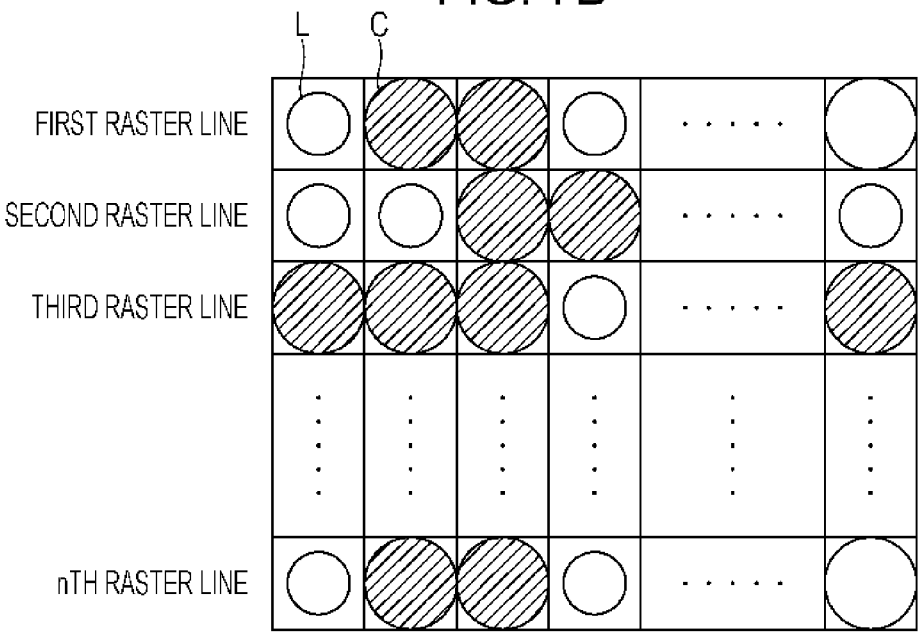
FIG. 7B is a diagram showing the second pattern of the discharge operations of the supplementary liquid and the imaging liquid according to the embodiment.
Figure 8A:
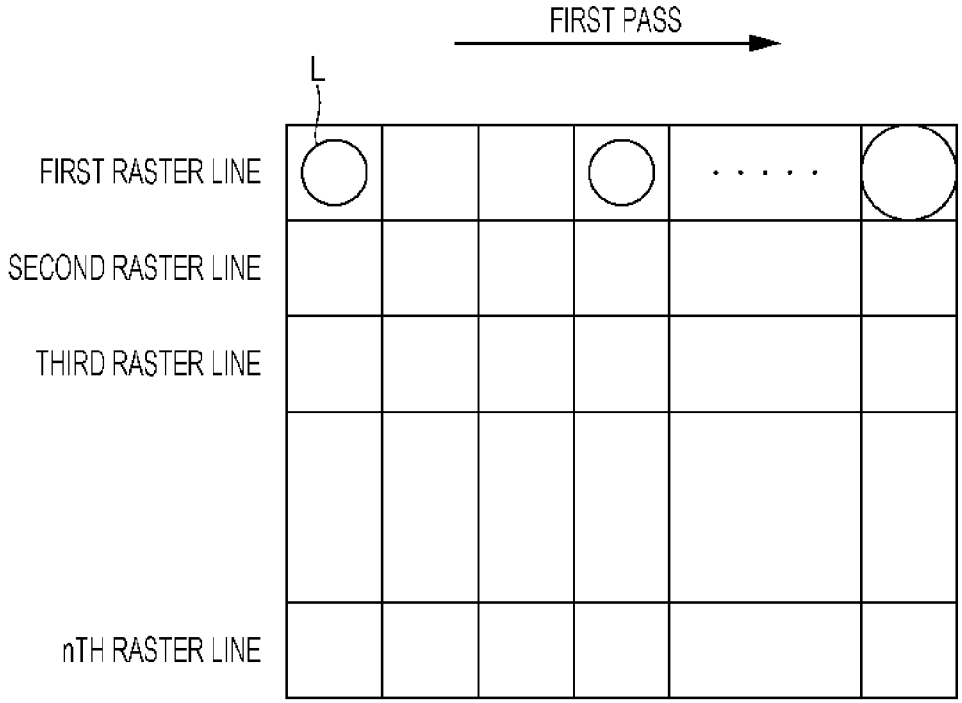
FIG. 8A is a diagram showing another example of the second pattern of the discharge operations of the supplementary liquid and the imaging liquid according to the embodiment.
Figure 8B:
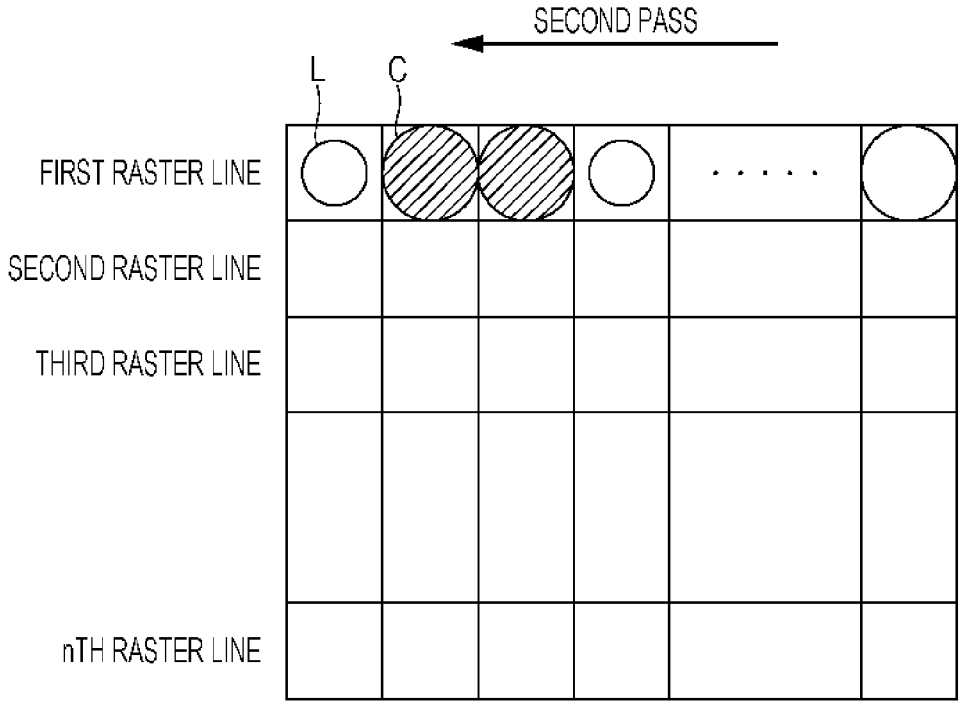
FIG. 8B is a diagram showing another example of the second pattern of the discharge operations of the supplementary liquid and the imaging liquid according to the embodiment.
Figure 8C:
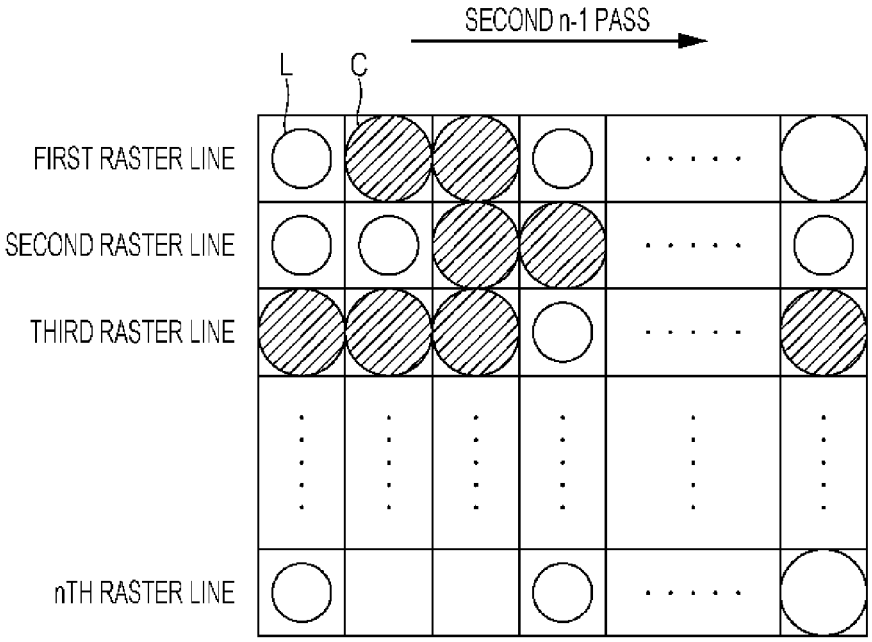
FIG. 8C is a diagram showing another example of the second pattern of the discharge operations of the supplementary liquid and the imaging liquid according to the embodiment.
Figure 8D:
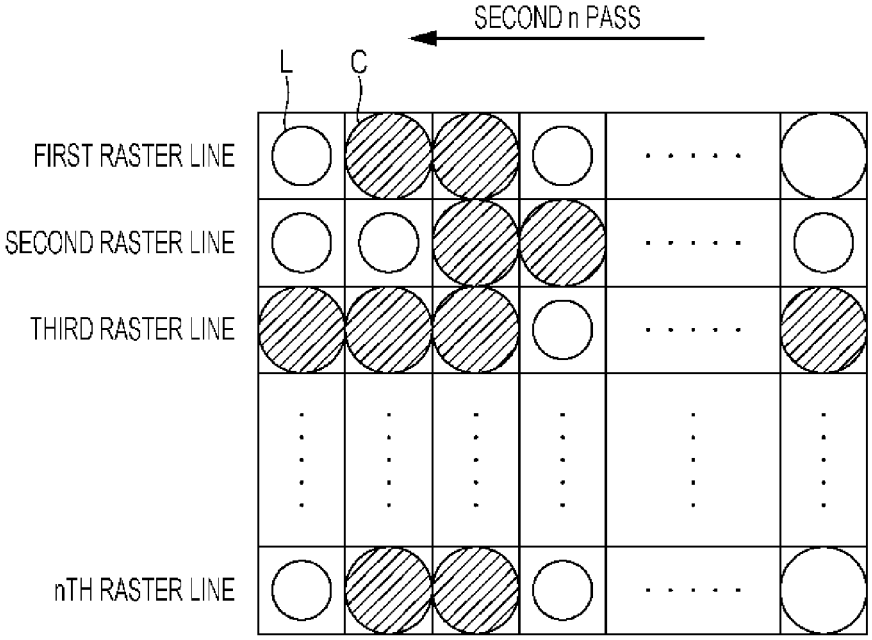
FIG. 8D is a diagram showing another example of the second pattern of the discharge operations of the supplementary liquid and the imaging liquid according to the embodiment.

Furthermore, the head 21 discharges the imaging liquid C onto a region that corresponds to the nth raster line and is a region on which the image is formed (the first region E1), in the same pass (the nth pass, refer to FIG. 6C). In other words, at the point in time at which the nth pass is complete, the imaging liquid C and the supplementary liquid L are discharged onto the nth raster line.

In this manner, it is possible to efficiently create a printed object by discharging the imaging liquid C and the supplementary liquid L in the same pass. It is possible to form a layer of the supplementary liquid L efficiently on the printing medium by discharging the supplementary liquid L only onto the regions on which the image is not formed.

Second Pattern

In the second pattern, the controller 60 controls the head 21 to execute the discharging of the imaging liquid C and the discharging of the supplementary liquid L in different passes, and to execute the discharging of the supplementary liquid L onto the regions (the second region E2 and the third region E3) onto which the imaging liquid C is not discharged.

According to this method, of the printing region of the printing medium at the printing position, a layer of the supplementary liquid L is formed only on the regions onto which the imaging liquid C is not discharged (the regions on which the image is not formed).

First, the head 21 moves from an initial position (for example, the upper left of the printing medium shown in FIG. 7A) two dimensionally in relation to the printing medium, and discharges the supplementary liquid L onto the regions (the second region E2 and the third region E3) onto which the imaging liquid C is not discharged. At this time, the head 21 reduces the discharge amount of the supplementary liquid L on the second region E2 to less than the discharge amount of the supplementary liquid L on the third region E3. In this case, in the printing medium in the printing position, dots of the supplementary liquid L are formed on the region onto which the imaging liquid C is not discharged (where the dots in the second region E2 are smaller than the dots in the third region E3, refer to FIG. 7A).

Next, the head 21 moves again from the initial position two dimensionally in relation to the printing medium, and discharges the imaging liquid C onto the region (the first region E1) on which the image is formed. In this case, dots of the imaging liquid C are formed on the region on which the image is formed (refer to FIG. 7B).

As described above, in the same manner as in the first pattern, it is possible to form a layer of the supplementary liquid L efficiently on the printing medium by discharging the supplementary liquid L only onto the regions on which the image is not formed. It is possible to secure the time to cause the discharged liquid to dry by causing the imaging liquid C and the supplementary liquid L to be discharged in different passes. Therefore, it is possible to reduce the mixing together of the imaging liquid C and the supplementary liquid L.

Note that there is also a different method for the second pattern. For example, the head 21 discharges the supplementary liquid L onto the regions (the second region E2 and the third region E3), which are a region that corresponds to the first raster line in the first pass, onto which the imaging liquid C is not discharged. At this time, the head 21 reduces the discharge amount of the supplementary liquid L on the second region E2 to less than the discharge amount of the supplementary liquid L on the third region E3 (refer to FIG. 8A). In this case, in the first raster line, a layer of the supplementary liquid L is formed on the regions onto which the imaging liquid C is not discharged. Next, the head 21 discharges the imaging liquid C onto a region that corresponds to the first raster line and is a region on which the image is formed (the first region E1), in the second pass (refer to FIG. 8B). In the same manner, the head 21 discharges the supplementary liquid L onto the regions (the second region E2 and the third region E3), which are a region that corresponds to the nth raster line in a second n−1 pass, onto which the imaging liquid C is not discharged. At this time, the head 21 reduces the discharge amount of the supplementary liquid L on the second region E 2to less than the discharge amount of the supplementary liquid L on the third region E3 (refer to FIG. 8C). Furthermore, the head 21 discharges the imaging liquid C onto a region that corresponds to the nth raster line and is a region on which the image is formed, in the second n pass (refer to FIG. 8D).

Other

Note that, in order to facilitate the description, in FIGS. 6A to 6C and 8A to 8D, description is given of an example in which the supplementary liquid L (the imaging liquid C) is discharged onto a region that corresponds to one raster line in one pass. On the other hand, for example, when using the head 21 in which there is a plurality of the nozzles n as shown in FIG. 3, it is also possible to simultaneously discharge the supplementary liquid L (the imaging liquid C) onto a region that corresponds to a plurality of raster lines in one pass.

In FIGS. 6A to 6C and 8A to 8D, description is given of an example in which the liquid is discharged in each reciprocal pass (for example, a first pass and a second pass); however, the invention is not limited thereto. For example, it is also possible to discharge the liquid in only one of the passes, such as in the first pass, the third pass . . . . In this case, it is possible to further secure the time to cause the discharged liquid to dry. Therefore, it is possible to further reduce the mixing together of the imaging liquid C and the supplementary liquid L.

Operation of Ink Jet Printer

Figure 9:
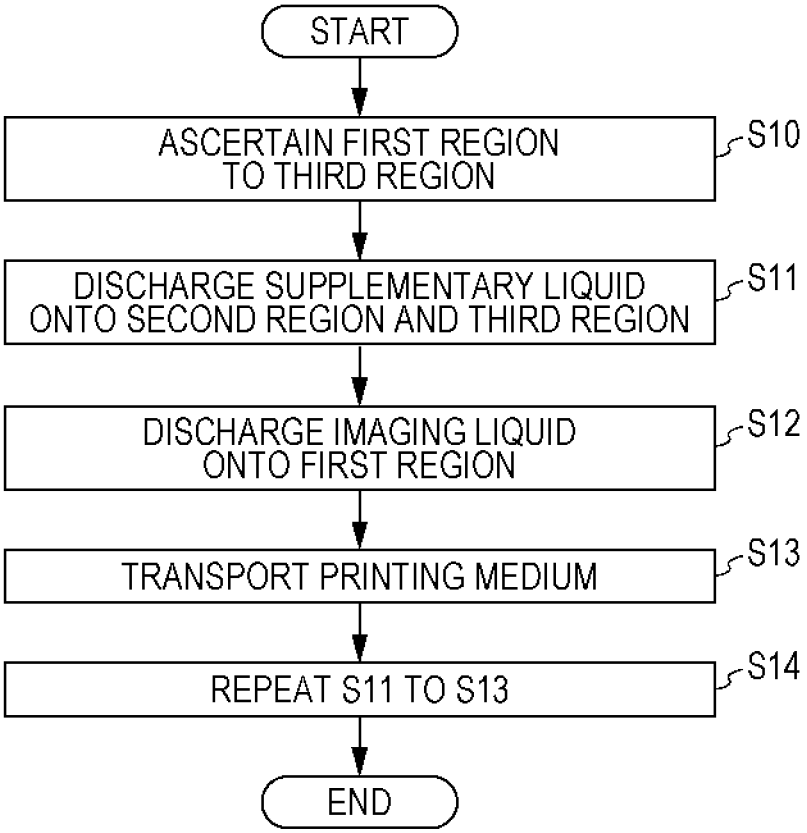
FIG. 9 is a flow chart showing the operations of the printing apparatus according to the embodiment.

Description will be given of the operation of the ink jet printer 1 in this embodiment with reference to FIG. 9.

First, the controller 60 analyses the image data, and ascertains the first region E1 to the third region E3 (S10).

The controller 60 controls the head 21 to discharge the imaging liquid C and the supplementary liquid L onto the printing medium on the basis of the result ascertained in S10.

Specifically, first, the controller 60 controls the head 21 to discharge the supplementary liquid L onto the second region E2 and the third region E3 (S11). In this case, the controller 60 controls the head 21 such that the discharge amount of the supplementary liquid L in the second region E2 is less than the discharge amount of the supplementary liquid L in the third region E3.

Next, the controller 60 controls the head 21 to discharge the imaging liquid C onto the first region E1 (S12). Note that, S11 and S12 may be performed in the same pass, and may also be performed in different passes.

When the formation of the image and the layer of the supplementary liquid on the printing medium in the printing position is completed, the controller 60 transports the printing medium to cause the region on which the image is not formed to be disposed in the printing position (S13).

The controller 60 repeats the processes S11 to S13 until the desired number of images are formed (S14).

Other Embodiment

The embodiments described above are intended to facilitate understanding of the invention and should not be interpreted as limiting the invention. It is needless to say that the invention may be modified and improved within a range not exceeding the spirit of the invention and furthermore, that the invention also includes equivalents thereto. In particular, even the embodiments described hereinafter are included in the invention.

The configuration of the head 21 is not limited to that shown in FIG. 3. It is sufficient for the head 21 to be configured to be capable of executing a discharge operation of liquid on the basis of the control of the controller 60 in the embodiment described above.

It is sufficient for the hot platen 41 and the drying mechanism 42 to be capable of causing the liquid (the ink) that forms the image and the layer of the supplementary liquid formed on the printing medium to dry. Therefore, for example, a configuration may also be adopted in which the printing medium is subjected to warm air, infrared rays, and electromagnetic waves such as microwaves. Alternatively, when ultraviolet (UV) curing ink is used, it is also possible to use a configuration in which the printing medium is irradiated with ultraviolet rays for the hot platen 41 and the drying mechanism 42.

For example, when the moisture is low, such as in winter, there is a likelihood that it is not easy to equalize the amount of charge with the discharge amount of the supplementary liquid that is set in advance. Therefore, it is possible to provide a plurality of modes in which the discharge amount of the supplementary liquid is different in the second operation.

For example, it is assumed that a first mode, in which a predetermined amount of the supplementary liquid is discharged, and a second mode, in which the discharge amount of the supplementary liquid is more than that of the first mode, are provided. These modes are stored in the memory 63 or the like. It is possible to perform the selection of the modes automatically or manually.

In the case of automatic selection, for example, the controller 60 compares the value (%) of moisture that is measured by the measurement unit 70 with a condition that is set in advance (for example, first mode: 30% or higher, second mode: 29% or lower). For example, when the measured moisture is 10%, the controller 60 selects and executes the second mode.

On the other hand, for example, in the case of manual selection, the operator of the ink jet printer 1, confirms the value indicated by an indoor hygrometer. When the value indicated by the hygrometer is low (for example, 10% moisture), the operator can determine that there is a high likelihood that a charge will be generated on the printing medium. In this case, the operator selects the second mode, which is set in advance, via an input unit (not shown) of the ink jet printer 1. The controller 60 executes the selected second mode. Note that the discharge operations of the liquid in the first mode and the second mode are the same as in the embodiment described above. In other words, even when the overall discharge amount of the supplementary liquid increases, the discharge amount of the supplementary liquid on the second region E2 is less than the discharge amount of the supplementary liquid on the third region E3.

It is also conceivable to increase the discharge amount of the supplementary liquid instead of providing specific modes.

In this case, for example, the controller 60 compares the measurement result from the measurement unit 70 and a predetermined threshold value. The predetermined threshold value is a value (for example, a value based on a moisture of 19% or less) for determining whether or not to cause the amount of the supplementary liquid that is discharged to be increased.

When the moisture measured by the measurement unit 70 is a predetermined threshold value or less, the controller 60 controls the head 21 to increase the discharge amount of the supplementary liquid. A predetermined value is set in advance for the increase amount of the supplementary liquid. Note that the discharge operations of the liquid are the same as in the embodiment described above. In other words, even when the overall discharge amount of the supplementary liquid increases, the discharge amount of the supplementary liquid on the second region E2 is less than the discharge amount of the supplementary liquid on the third region E3.

When selecting the first mode or the second mode, conditions other than the moisture may be considered. For example, depending on the type or the demanded image quality of the image to be printed, there may also be a case in which the influence of satellites may not be considered. Alternatively, in general, since clear ink costs more than colored ink, when the overall cost of printing is considered, there may also be a case in which the amount of clear ink used should be reduced. In such a case, for example, the operator may set the first mode via the input unit (not shown) of the ink jet printer 1. The controller 60 executes the first mode, which is set regardless of the moisture or the like.

Figure 10:
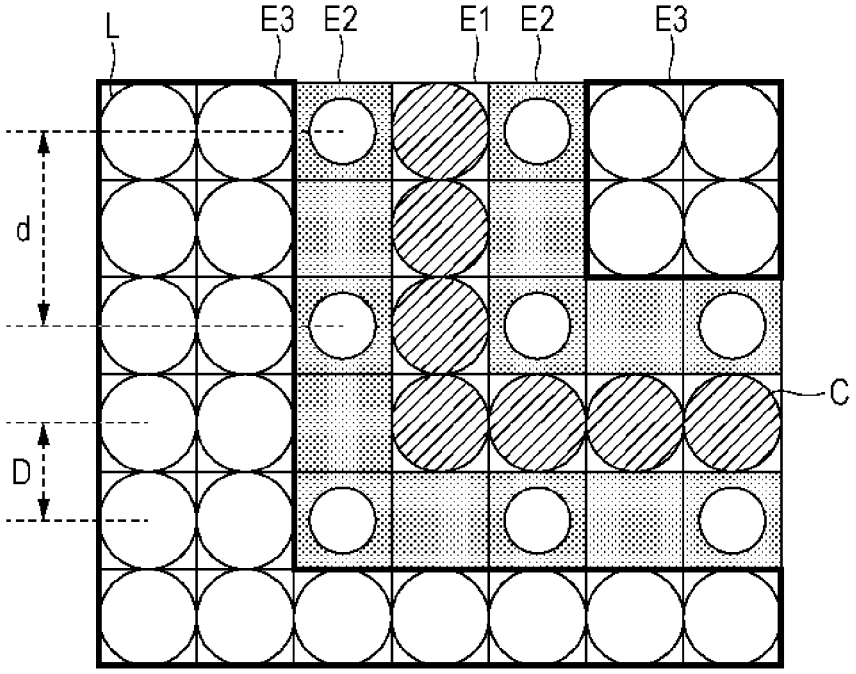
FIG. 10 is a diagram that supplements the description of the control of the discharge operation according to another embodiment.
Figure 11:
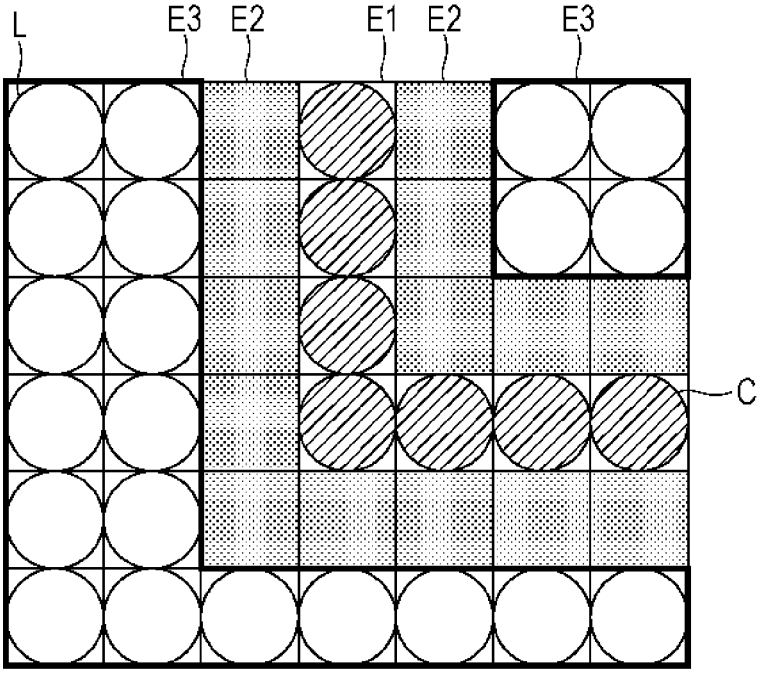
FIG. 11 is a diagram that supplements the description of the control of the discharge operation according to the other embodiment.

The control of the discharge operations of the supplementary liquid onto the second region E2 is not limited to that of the embodiment described above. FIGS. 10 and 11 are enlarged diagrams of a portion of the printing medium onto which the imaging liquid C and the supplementary liquid L are discharged. In FIGS. 10 and 11, the discharged liquid (the dots) is represented by circles. In FIGS. 10 and 11, each of the square-shaped regions, on which a dot is disposed, illustrates one pixel region.

For example, the controller 60 can control the head 21 such that an interval d of the dots of the supplementary liquid L that is discharged onto the second region E2, is wider than an interval D of the dots of the supplementary liquid L that is discharged onto the third region E3 (refer to FIG. 10).

As a specific example, when the controller 60 determines a plurality of pixel regions to be the second region E2, the pixel region onto which the supplementary liquid L is to be discharged in the second region E2 is set to an arbitrary interval. The arbitrary interval is a wider value than the interval of the pixel region onto which the supplementary liquid L is discharged in the third region E3. For example, it is possible to set the arbitrary interval by removing the second region E2 for every other pixel region. The controller 60 controls the head 21 to discharge the supplementary liquid L onto only the set pixel regions within the second region E2. In this manner, it is possible to further reduce the mixing together of the imaging liquid C and the supplementary liquid L by widening the interval of the dots of the supplementary liquid L that is discharged onto the second region E2. It is also possible to reduce the amount of the supplementary liquid L used.

Alternatively, it is possible for the controller 60 to control the head 21 to not discharge the supplementary liquid L onto the determined second region E2 (refer to FIG. 11). In this case, it is also possible to reduce the mixing together of the imaging liquid C and the supplementary liquid L. It is also possible to reduce the amount of the supplementary liquid L used.

Figure 12:
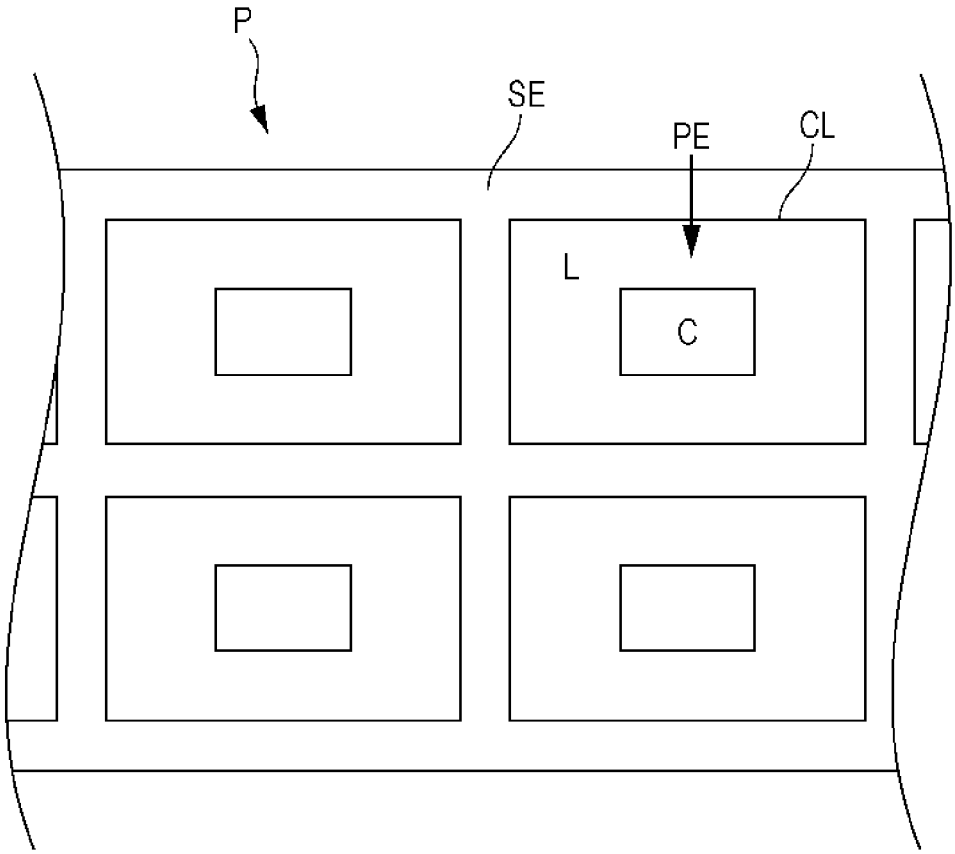
FIG. 12 is a diagram showing a printed object according to the other embodiment.

FIG. 12 is a schematic diagram showing an example of a printed object P that is printed by the ink jet printer 1. As shown in FIG. 12, depending on the printed object P, there is a case in which a printing region PE onto which the imaging liquid C or the supplementary liquid L is discharged, and a region SE, which is peeled off after the image is formed in the region onto which the imaging liquid C is discharged are formed.

Therefore, when the peel-off region SE is present, the controller 60 controls the head 21 to not execute the second operation (the discharging of the supplementary liquid L) in relation to the peel-off region SE. Specifically, the controller 60 sets the printing region PE in relation to the printing medium in the printing position in advance on the basis of the image data or the like that indicates the size of the printing medium, the number of images to print, and the image to print. The controller 60 performs printing in relation to the printing region PE.

On the other hand, when a region other than the set printing region PE is present on the printing medium in the printing position, the controller 60 determines the region to be the peel-off region SE. The controller 60 controls the head 21 to not discharge the supplementary liquid L onto the peel-off region SE. Note that, the boundary between the printing region PE and the peel-off region SE is referred to as the "cut line CL". It is possible to determine the cut line CL on the basis of the image data or the like.

As described above, it is possible to reduce the influence of satellites by equalizing the distribution of the amount of charge. However, in actuality, the distribution of the satellites has merely become uniform together with the equalization of the distribution of the amount of charge, and the satellites accumulate on the printing region. Therefore, the supplementary liquid is not discharged onto the peel-off region SE, and by actually leaving a portion on which the distribution of the amount of charge is uneven, it is possible to selectively cause the satellites to accumulate on the portion (the peel-off region SE). Accordingly, it is possible to further reduce the influence of satellites in the printing region PE.

The imaging liquid and the supplementary liquid may be aqueous inks, or may be oil-based inks.

The liquid is not limited to being an ink, and it is also possible to use a liquid other than ink (including, in addition to a liquid, a liquid body in which particles of a functional material are dispersed, and a fluid body such as a gel), and fluid bodies other than liquids (including solids that can flow as fluids and can be discharged).

It is also possible to apply the configuration of the embodiment described above to a line printer, or a serial scanning system ink jet printer. The serial scanning system is a system in which the image is formed by repeatedly performing the discharging of the liquid and the transportation of the printing medium. In other words, when performing formation of the image using the serial system, at the point in time at which the printing medium is transported, an image that is based on the image data is not yet completed. A Large Format Printer (LFP) is an example of the serial scanning system ink jet printer.

The entire disclosure of Japanese Patent Application No. 2013-065798, filed Mar. 27, 2013 is expressly incorporated by reference herein.

What is claimed is:

1. A printing apparatus, comprising:

a head which discharges an imaging liquid for forming an image, and a supplementary liquid for supplementing formation of the image with the imaging liquid onto a printing medium; and a control unit which controls the head to execute a first operation, in which the imaging liquid is discharged onto a first region of the printing medium, and a second operation, in which the supplementary liquid is discharged onto a region of the printing medium onto which the imaging liquid is not discharged, wherein the control unit controls the head such that a discharge amount of the supplementary liquid on a second region, which is a region onto which the imaging liquid is not discharged and is adjacent to the first region, is less than the discharge amount of the supplementary liquid on a third region, which is a region onto which the imaging liquid is not discharged and is not adjacent to the first region.

2. The printing apparatus according to claim 1, wherein the control unit controls the head such that a dot size of the supplementary liquid that is discharged onto the second region is smaller than the dot size of the supplementary liquid that is discharged onto the third region.

3. The printing apparatus according to claim 1, wherein the control unit controls the head such that an interval of dots of the supplementary liquid that is discharged onto the second region, is wider than the interval of the dots of the supplementary liquid that is discharged onto the third region.

4. The printing apparatus according to claim 1, wherein the control unit controls the head to not discharge the supplementary liquid onto the second region.

5. The printing apparatus according to claim 1, wherein the control unit is capable of selectively executing a plurality of modes in which the discharge amount of the supplementary liquid in the second operation differs.

6. The printing apparatus according to claim 1, further comprising:

a measurement unit which measures a moisture of the printing medium, wherein, when a measurement result obtained by the measurement unit is a predetermined threshold value or less, the control unit controls the head to increase the discharge amount of the supplementary liquid.

7. The printing apparatus according to claim 1, wherein the control unit controls the head to execute the first operation and the second operation in a same pass.

8. The printing apparatus according to claim 1, wherein, when a region, which is peeled off after the image is printed, is present in a region onto which the imaging liquid is not discharged, the control unit controls the head to not execute the second operation in relation to the peel-off region.

* * * * *